US006869178B2

(12) United States Patent
Yau et al.

(10) Patent No.: US 6,869,178 B2
(45) Date of Patent: Mar. 22, 2005

(54) INK JET PRINTING METHOD

(75) Inventors: Hwei-Ling Yau, Rochester, NY (US); David E. Decker, Rochester, NY (US); Xiaoru Wang, Rochester, NY (US); Wendy S. Krzemien, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/289,607

(22) Filed: Nov. 7, 2002

(65) Prior Publication Data

US 2004/0090512 A1 May 13, 2004

(51) Int. Cl.[7] ..... B41J 2/01; B41M 5/00

(52) U.S. Cl. ..... 347/105; 347/101; 428/195; 428/32.1

(58) Field of Search ..... 347/101, 105; 428/32.1, 195

(56) References Cited

U.S. PATENT DOCUMENTS

| | | | | |
|---|---|---|---|---|
| 4,832,984 A | | 5/1989 | Hasegawa et al. | |
| 4,880,686 A | * | 11/1989 | Yaegashi et al. | 428/32.75 |
| 5,264,279 A | * | 11/1993 | Imamura et al. | 428/32.39 |
| 5,376,434 A | * | 12/1994 | Ogawa et al. | 428/195.1 |
| 5,700,582 A | * | 12/1997 | Sargeant et al. | 428/32.31 |
| 5,965,304 A | * | 10/1999 | Yau et al. | 430/11 |
| 6,130,014 A | * | 10/2000 | Yau et al. | 430/14 |
| 6,184,268 B1 | * | 2/2001 | Nichols et al. | 523/160 |
| 6,399,156 B1 | | 6/2002 | Wexler et al. | |
| 6,454,404 B1 | * | 9/2002 | Lawrence et al. | 347/100 |
| 6,503,608 B2 | * | 1/2003 | Lawrence et al. | 347/105 |
| 6,686,001 B2 | * | 2/2004 | Gallo et al. | 428/32.36 |

FOREIGN PATENT DOCUMENTS

| | | |
|---|---|---|
| EP | 0 858 905 A1 | 8/1998 |
| EP | 1 078 775 A2 | 2/2001 |
| JP | 59-222381 | 12/1984 |

* cited by examiner

*Primary Examiner*—Lamson Nguyen
*Assistant Examiner*—Leonard S Liang
(74) *Attorney, Agent, or Firm*—Harold E. Cole; Chris P. Konkol

(57) ABSTRACT

An ink jet printing method having the steps of: A) providing an ink jet printer that is responsive to digital data signals; B) loading the printer with an ink jet recording element having a support having thereon a fusible, porous, image-receiving layer containing at least two types of hydrophobic polymer particles having different glass transition temperatures, the first type of hydrophobic polymer particles having a Tg higher than about 60° C. that is substantially monodisperse and the second type of hydrophobic polymer particles having a Tg lower than about 25° C.; C) loading the printer with an ink jet ink; and D) printing on the image-receiving layer using the ink jet ink in response to the digital data signals.

14 Claims, 4 Drawing Sheets

SEM of Control Element C-1

SEM of Control Element C-2

SEM of Element 1 of the invention

SEM of Element 5 of the invention

SEM of Element 11 of the invention

INK JET PRINTING METHOD

CROSS REFERENCE TO RELATED APPLICATION

Reference is made to commonly assigned, co-pending U.S. patent application Ser. No. 10/289,862 by Yau et al. filed of even date herewith entitled "Ink Jet Recording Element".

FIELD OF THE INVENTION

The present invention relates to an ink jet printing method using a porous ink jet recording element containing two types of polymer particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

Ink jet prints, prepared by printing onto ink jet recording elements, are subject to environmental degradation. They are especially vulnerable to damage resulting from contact with water and atmospheric gases such as ozone. The damage resulting from the post imaging contact with water can take the form of water spots resulting from deglossing of the top coat, dye smearing due to unwanted dye diffusion, and even gross dissolution of the image recording layer. Ozone bleaches ink jet dyes resulting in loss of density. To overcome these deficiencies ink jet prints are often laminated. However, lamination is expensive since it requires a separate roll of material. Print protection can also be provided by coating a polymer solution or dispersion onto the surface of an ink jet element after the image is formed. The aqueous coating solutions are often polymer dispersions capable of film formation when water is removed. However, due to the wide variety of surface properties, it is difficult to formulate an aqueous polymer solution to be universally compatible to all ink jet receivers.

Alternatively, ink jet recording elements having a two layer construction, such as described in EP1078775A2, JP59222381 and U.S. Pat. No. 4,832,984 have been employed. These elements typically have a porous ink transporting topcoat of thermally fusible particles residing on either a swellable or porous ink-retaining layer. Upon printing, the ink passes through the topcoat and into an ink-retaining layer. The topcoat layer is then sealed to afford a water and stain resistant print. Such topcoats containing thermally fusible particles typically either contain a binder or are thermally sintered to provide a level of mechanical integrity to the layer prior to the imaging and fusing steps.

JP 256099694 discloses an ink jet recording element wherein the image-receiving layer contains latex or wax particles of 0.1 to 5.0 $\mu$m in diameter. While this recording element has a porous surface, the image-receiving layer has very poor integrity and tends to powder off the support which creates image defects.

EP 0858905 A1 discloses the preparation of a recording medium comprising a porous outermost layer by coating and drying a particulate thermoplastic resin above its glass transition temperature (Tg), but below its minimum film formation temperature (MFFT). However, there is a problem with this element in that the drying temperature has to be controlled very precisely between the Tg and MFFT in order to achieve the desired result.

EP 0858906 relates to a base material, a porous ink-receiving layer and a porous surface layer having good ink capacity. However, it would be desirable to obtain good ink capacity without the need of using a separate ink-receiving layer.

It is an object of this invention to provide an ink jet printing method using a novel porous ink jet recording element that absorbs inks instantly, and after imaging, provides an image which has good quality and is water and abrasion resistant. It is another object of the invention to provide an ink jet printing method using a porous ink jet recording element which is easy to manufacture.

SUMMARY OF THE INVENTION

These and other objects are achieved in accordance with the invention which comprises an ink jet printing method comprising the steps of:

A) providing an ink jet printer that is responsive to digital data signals;

B) loading the printer with an ink jet recording element comprising a support having thereon a fusible, porous, image-receiving layer comprising at least two types of hydrophobic polymer particles having different glass transition temperatures, the first type of hydrophobic polymer particles having a Tg higher than about 60° C. that is substantially monodisperse and the second type of hydrophobic polymer particles having a Tg lower than about 25° C.;

C) loading the printer with an ink jet ink; and

D) printing on the image-receiving layer using the ink jet ink in response to the digital data signals.

By use of the method of the invention, a print is obtained that is "instant" dry to the touch, has good image quality, and after fusing, has satisfactory abrasion and water-resistance.

Due to the lack of light-scattering matters in the ink receiving layer after fusing, the elements employed in the invention are especially suitable for ink jet transparency media and medical imaging media.

DETAILED DESCRIPTION OF THE INVENTION

Figure 1A:
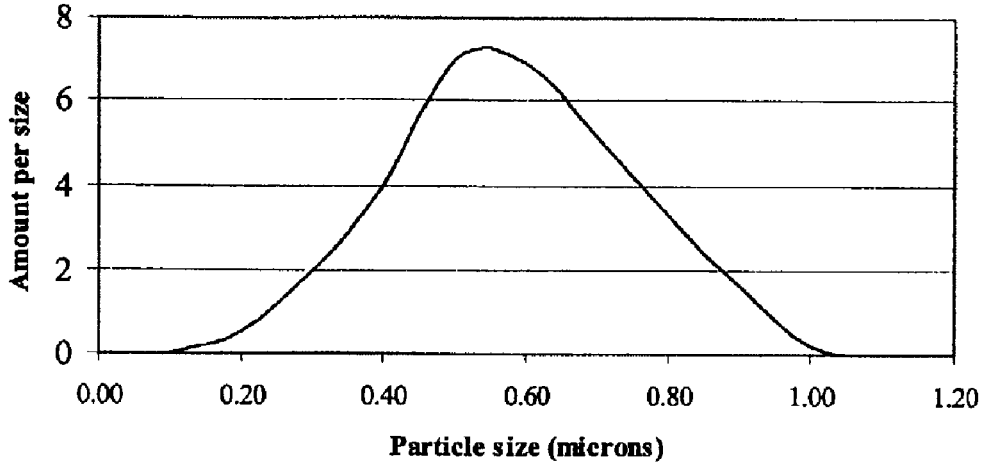
FIG. 1*a* and FIG. 1*b* are sample printouts of particle size data obtained using Ultrafine Particle Analyzer.

The first type of hydrophobic polymer particles used in the invention which is substantially monodisperse can be prepared, for example, by emulsion polymerization of ethylenically unsaturated monomers with or without surfactants. Any suitable ethylenically unsaturated monomer or mixture of monomers may be used in making monodisperse polymer particles. There may be used, for example, ethylene, propylene, 1-butnene, butadiene, styrene, α-methylstyrene, vinyltoluene, t-butylstyrene; monoethylenic unsaturated esters of fatty acids (such as vinyl acetate, allyl acetate, vinyl stearate, vinyl pivalate); monoethylenic unsaturated amides of fatty acids (such as N-vinylacetamide, N-vinylpyrrolidone); ethylenic unsaturated mono-carboxylic acid or dicarboxylic acid esters (such as methyl acrylate, ethyl acrylate, propylacrylate, 2-chloroethylacrylate, 2-cyanoethylacrylate, hydroxyethyl acrylate, methyl methacrylate, n-butyl methacrylate, benzyl acrylate, 2-ethylhexyl acrylate, cyclohexyl methacrylate, tetrahydrofurfuryl acrylate, tetrahydrofurfuryl methacrylate, isobornylacrylate, isobornylmethacrylate, n-octyl acrylate, diethyl maleate, diethyl itaconate); ethylenic unsaturated monocarboxylic acid amides (such as acrylamide, t-butylacrylamide, isobutylacrylamide, n-propylacryamide, dimethylacrylamide, methacrylamide, diacetoneacrylamide, acryloylmorpholine); and mixtures thereof. Up to 5% by weight based on total monomer mixture of water soluble monomers can also be copolymerized to improve particles stability. Examples of preferred water soluble comonomers are ethylenic unsaturated salts of sulfonate or sulfate (such as sodium acrylamide-2-methylpropane-sulfonate, sodium vinylbenzenesulfonate, potassium vinylbenzylsulfonate, sodium vinylsulfonate); mono-ethylenic unsaturated compounds (such as acrylonitrile, methacrylonitrile), and monoethylenic unsaturated carboxylic acid (such as acrylic acid, methacrylic acid, itaconic acid, maleic acid).

If desired, monomers containing a UV absorbing moiety, antioxidant moiety or crosslinking moiety may be used in forming the monodisperse polymer particles in order to improve light fastness of the image or other performance. Examples of UV absorbing monomers that can be used include the following:

TABLE 1

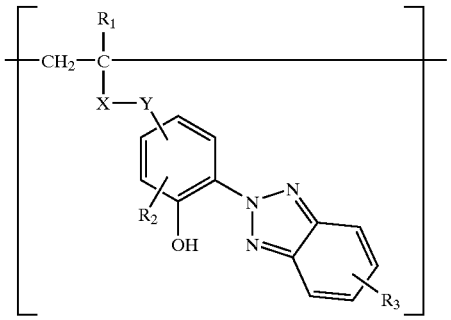

| UV-Absorber | $R_1$ | $R_2$ | $R_3$ | X | Y |
|---|---|---|---|---|---|
| UV-1 | $CH_3$ | H | H | COO | $(CH_2)_2$ |
| UV-2 | H | H | Cl | COO | $(CH_2)_3$ |
| UV-3 | H | H | H | 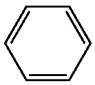 | $CH_2O$ |
| UV-4 | $CH_3$ | $C(CH_3)_3$ | H | COO | $(CH_2)_3$ |
| UV-5 | H | $CH_3$ | H | CONH | $CH_2$ |
| UV-6 | H | $CH_3$ | $OCH_3$ | CONH | $CH_2$ |
| UV-7 | H | $C(CH_3)_3$ | Cl | CONH | $CH_2$ |
| UV-8 | $CH_3$ | H | H | COO | $(CH_2)_2OCONH$ |
| UV-9 | $CH_3$ | Cl | H | COO | $H_2C—CH(OH)—CH_2O$ |
| UV-10 | $CH_3$ | H | Cl | COO | $(CH_2)_3$ |
| UV-11 | H | H | Cl | COO | $(CH_2)_3$ |
| UV-12 | $CH_3$ | H | Cl | COO | $(CH_2)_2—O—C(=O)—(CH_2)_2$ |
| UV-13 | H | H | Cl | COO | $(CH_2)_2—O—C(=O)—(CH_2)_2$ |

TABLE 1-continued

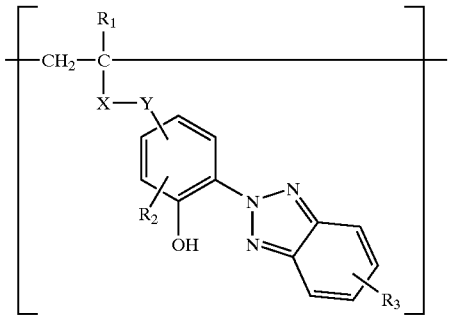

| UV-Absorber | $R_1$ | $R_2$ | $R_3$ | X | Y |
|---|---|---|---|---|---|
| UV-14 | $CH_3$ | H | Cl | COO | $(CH_2)_2$—NH—C(=O)—$(CH_2)_2$ |
| UV-15 | H | $CH_3$ | H | 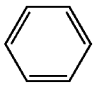 | $CH_2$ |
| UV-16 | H | $CH_3$ | Cl | COO | $(CH_2)_3$ |
| UV-17 | H | $CH_3$ | H | COO | $(CH_2)_2$ |
| UV-18 | $CH_3$ | H | Cl | COO | $(CH_2)_2O$ |
| UV-19 | H | H | Cl | COO | $(CH_2)_2$ |

Typical crosslinking monomers which can be used in forming the monodisperse polymer particles employed in the invention include aromatic divinyl compounds such as divinylbenzene, divinylnaphthalene or derivatives thereof; diethylene carboxylate esters and amides such as ethylene glycol dimethacrylate, diethylene glycol diacrylate, and other divinyl compounds such as divinyl sulfide or divinyl sulfone compounds. Divinylbenzene and ethylene glycol dimethacrylate are especially preferred.

Examples of a monodisperse polymer particle preparation can be found in "Emulsion Polymerization and Emulsion Polymers", P. A. Lovell and M. S. El-Aasser, John Wiley & Sons, Ltd., 1997, and U.S. Pat. No. 4,415,700, the disclosures of which are hereby incorporated by reference.

The monodisperse polymer particles used in the invention are non-porous. By non-porous is meant a particle that is either void-free or not permeable to liquids. These particles can have either a smooth or a rough surface.

The second type of hydrophobic polymer having a Tg of less than 25° C. used in the present invention can be a latex or a hydrophobic polymer of any composition that can be stabilized in an water-based medium. Such hydrophobic polymers are generally classified as either condensation polymers or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers as described above for preparing monodisperse polymer particles. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. The aqueous phase of the latex or colloidal dispersion employed in the invention may contain water-soluble polymers in order to control, for example, the viscosity and flow characteristics. The aqueous phase may also include surfactants of the cationic, anionic, zwitterionic or non-ionic types. Further listings of suitable monomers for addition type polymers are found in U.S. Pat. No. 5,594,047, the disclosure of which is hereby incorporated by reference.

In a preferred embodiment of the invention, the Tg of the first type of polymer particle is from about 60° C. to about 140° C. In another embodiment, the Tg of the second hydrophobic polymer is from about −60° C. to about 25° C. In still another preferred embodiment, the monodisperse polymer particles having a Tg of from about 60° C. to about 140° C. have an average particle size of from about 0.2 $\mu$m to about 2 $\mu$m. The average particle size is defined as the size (or diameter) that 50% by volume of particles are smaller than.

In yet another preferred embodiment, the monodisperse polymer particles have a decade ratio of less than about 2, where the decade ratio is an index of monodispersity and is defined as the ratio of the particle size at the $90^{th}$ percentile of the particle size distribution curve to the particle size at the $10^{th}$ percentile. Percentile is defined as the given percent of the volume that is smaller than the indicated size. In yet still another preferred embodiment, the weight ratio of the high Tg monodisperse polymer particles to the low Tg hydrophobic polymer is from about 10:1 to about 2.5:1

After printing on the element employed in the invention, the fusible, porous ink-receiving layer is heat and/or pressure fused to form a substantially continuous, transparent layer on the surface. Upon fusing, this layer is rendered non-light scattering. Fusing may be accomplished in any manner which is effective for the intended purpose. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference.

In a preferred embodiment, fusing is accomplished by contacting the surface of the element with a heat fusing member, such as a fusing roller or fusing belt. Thus, for example, fusing can be accomplished by passing the element through a pair of heated rollers, heated to a temperature of about 60° C. to about 160° C., using a pressure of 5 to about 15 MPa at a transport rate of about 0.005 m/sec to about 0.5 m/sec.

The image-receiving layer may also contain additives such as pH-modifiers, rheology modifiers, surfactants, UV-absorbers, biocides, lubricants, waxes, dyes, optical brighteners, etc.

The image-receiving layer may be applied to one or both substrate surfaces through conventional pre-metered or post-metered coating methods such as blade, air knife, rod, roll, slot die, curtain, slide, etc. The choice of coating process would be determined from the economics of the operation and in turn, would determine the formulation specifications such as coating solids, coating viscosity, and coating speed.

The image-receiving layer thickness before fusing may range from about 10 to about 100 μm, preferably from about 20 to about 70 μm. The coating thickness required is determined through the need for the coating to act as a sump for absorption of ink solvent. In general, the image-receiving layer is coated in an amount of from about 10 $g/m^2$ to about 60 $g/m^2$. Further, the pore volume of the fusible, porous, image-receiving layer in general is from about 5 to about 50 $ml/m^2$.

The support used in the ink jet recording element employed in the invention may be opaque, translucent, or transparent. There may be used, for example, plain papers, resin-coated papers, laminated paper, such as those described in U.S. Pat. Nos. 5,853,965; 5,866,282; 5,874,205; 5,888,643; 5,888,681; 5,888,683; and 5,888,714, various plastics including a polyester resin such as poly(ethylene terephthalate), poly(ethylene naphthalate) and poly(ester diacetate), cellulosics, such as cellulose acetate, cellulose diacetate and cellulose triacetate, a polycarbonate resin, a fluorine resin such as poly(tetra-fluoro ethylene), metal foil, various glass materials, and the like. The support may also be void-containing polyolefin, polyester or membrane. Examples of void-containing polyester preparation can be found in U.S. Pat. Nos. 5,354,601 and 6,379,780. A voided membrane can be formed in accordance with the known technique of phase inversion. The thickness of the support employed in the invention can be from about 12 to about 500 μm, preferably from about 75 to about 300 μm.

If desired, in order to improve the adhesion of the porous particle layer to the support, the surface of the support may be corona-discharge-treated prior to applying the base layer or solvent-absorbing layer to the support.

During the ink jet printing process, ink droplets are rapidly absorbed into the porous coating through capillary action and the image is dry-to-touch right after it comes out of the printer. Therefore, porous coatings allow a fast "drying" of the ink and produces a smear-resistant image.

Since the image recording element may come in contact with other image recording articles or the drive or transport mechanisms of image recording devices, additives such as surfactants, lubricants, matte particles and the like may be added to the element to the extent that they do not degrade the properties of interest.

Ink jet inks used to image the recording elements employed in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

When anionic dyes are used in ink jet inks to image the recording elements employed in the invention, it is preferred that the first type of hydrophobic polymer particles used in the recording element are cationic. The cationic characteristics can be obtained from a cationic comonomer, cationic surfactant or cationic initiator employed in the polymerization.

When cationic dyes are used in ink jet inks to image the recording elements employed in the invention, it is preferred that the first type of hydrophobic polymer particles used in the recording element are anionic. The anionic characteristics can be from an anionic comonomer, anionic surfactant or anionic initiator employed in the polymerization.

When pigmented inks are used in ink jet inks to image the recording elements employed in the invention, it is preferred that the pigments penetrate into the porous image-receiving layer employed in the recording element. Thus, it is desirable that the average particle size of the pigments used in ink jet inks to image the recording elements employed in the invention are about 18% or less than the average particle size of the first type of hydrophobic polymer particles used in the recording element. In a preferred embodiment, the particle size of the pigments used in the ink jet ink is less than about 200 nm, preferably less than about 90 nm.

The following examples are provided to illustrate the invention.

EXAMPLES

Example 1

Preparation of Monodisperse Polymer Particles

Particles of this invention were prepared from one of the three processes given below.

Process A: Preparation of Anionic Monodisperse Polymer Particles in the Presence of Surfactant A two-liter reaction flask was prepared by adding 753 g of demineralized water, 2.56 g of Aerosol MA-80, (Cytek Industries, Inc.), and a variable amount of sodium carbonate. The flask contents were heated to 80° C. with 150 RPM stirring in a nitrogen atmosphere. An aqueous phase addition flask was made up with 649 g of demineralized water, 3.38 g of Aerosol MA-80 and 3.78 g of sodium persulfate. A monomer phase addition flask was prepared by adding 1011.4 g of ethyl methacrylate and 164.6 g of methyl methacrylate. Then, 3.43 g of sodium persulfate was added to the reaction flask. Within two minutes, 498 g of the aqueous phase, and 820 g of the monomer phase were added over three hours. The reactor contents were then heated for two hours at 80° C. followed by cooling to 20° C., and filtrated through a 200 μm polycloth. The latex was concentrated to 50% solids by ultrafiltration. The latex particle size was controlled by the amount of monomer phase and sodium carbonate added. Surfactant and initiator concentrations were kept constant at 0.5 wt. % and 0.7 wt. % based on monomer, respectively. For example, at 40% reaction solids with no sodium carbonate, the median particle size was 517.7 nanometers, and at 50% reaction solids with 7.84 g sodium carbonate, the median particle size was 831.6 nanometers. When 800 nanometer particles were desired, a staggered feed of the monomer phase was necessary to avoid monomer pooling and a large exotherm. To do this, 507 g of the aqueous phase was charged over 3.5 hours.

Concurrently, 40 g of the monomer phase were charged over the first 30 minutes, then 940 g were charged over the next three hours.

Process B: Preparation of Surfactant-Free Anionic Monodisperse Polymer Particles A 12-liter, Morton reaction flask was prepared by adding 2000 g of demineralized water. The flask contents were heated to 80° C. with 150 RPM stirring in a nitrogen atmosphere. A first aqueous phase addition flask was made up with 1987 g of demineralized water and 13.2 g of sodium metabisulfite. A second aqueous phase addition flask was made up with 1973 g of demineralized water and 26.4 g of sodium persulfate. A monomer phase addition flask was prepared by adding 2182 g of ethyl methacrylate and 364 g of methyl methacrylate. Then, charges to the reaction flask from each addition flask were started at 5 g per minute. The addition flasks were recharged as needed. Samples were taken at various times and the monomer phase feed was stopped when the desired latex particle size was reached. The charges of the redox initiator solutions were extended for 30 minutes beyond the end of the monomer phase addition to chase residual monomers. The reaction flask contents were stirred at 80° C. for one hour followed by cooling to 20° C., and filtration through 200 $\mu$m polycloth. The latex was concentrated to 50% solids by ultrafiltration.

Process C: Preparation of Surfactant-Free Cationic Monodisperse Polymer Particles A 12-liter, Morton reaction flask was prepared by adding 4000 g of demineralized water. The flask contents were heated to 80° C. with 150 RPM stirring in a nitrogen atmosphere. The initiator solution addition flask was made up with 1974 g of demineralized water and 26.4 g of 2,2'-azobis(2-methylpropionamidine)dihydrochloride. A monomer phase addition flask was prepared by adding 2182 g of ethyl methacrylate and 364 g of methyl methacrylate. Then, charges to the reaction flask from each addition flask were started at 5 g per minute. The addition flasks were recharged as needed. Samples were taken at various times and the monomer phase feed was stopped when the desired latex particle size was reached. The charges of the redox initiator solutions were extended for 30 minutes beyond the end of the monomer phase addition to chase residual monomers. The reaction flask contents were stirred at 80° C. for one hour followed by cooling to 20° C., and filtration through a 200 $\mu$M polycloth. The latex was concentrated to 50% solids by ultrafiltration.

Preparation of Comparison Polymer Particles CP-1 (Broad Particle Size Distribution)

An organic composition was prepared by dissolving 47.9 g of cellulose acetate butyrate (Eastman Chemicals CAB 551-0.2) in 112.7 g of ethyl acetate at 68° C. with mixing. An aqueous composition was prepared by dissolving 13.4 g of a 10% solution of Alkanol XC® (DuPont Corp.) in 361.3 g of water and heating to 68° C. The aqueous phase was added to the organic phase using low shear mixing and the combined phases were passed 2 times through a Gaulin Colloid mill high shear mixer to form a particulate premix. The resulting premix was rotary evaporated to remove the ethyl acetate resulting in a cellulose acetate butyrate particulate dispersion.

Preparation of Comparison Polymer Particles CP-2 (Broad Particle Size Distribution)

CP-2 was prepared similar to process A, except that the aqueous phase and monomer phase were combined, pre-emulsified and fed into the reaction flask from the single addition flask. The monomer emulsion was not stable, there was monomer pooling in the reactor, and the reaction heat output was not constant. Particle size distribution data obtained by an Ultrafine Particle Analyzer indicated a bimodal particle size distribution.

Characterization of Polymer Particles

Glass Transition Temperature

The Tg of the dry polymer materials was determined by differential scanning calorimetry (DSC), using a heating rate of 20° C./minute, and is shown in Table 2 below. Tg is defined herein as the inflection point of the glass transition.

Particle Size Measurement

Figure 1B:
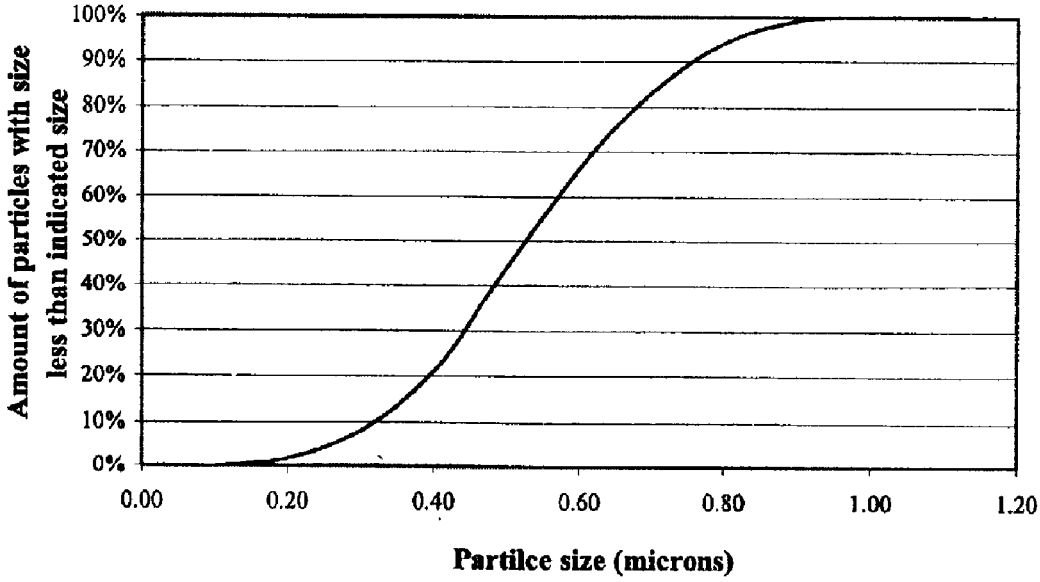
Figure 2:
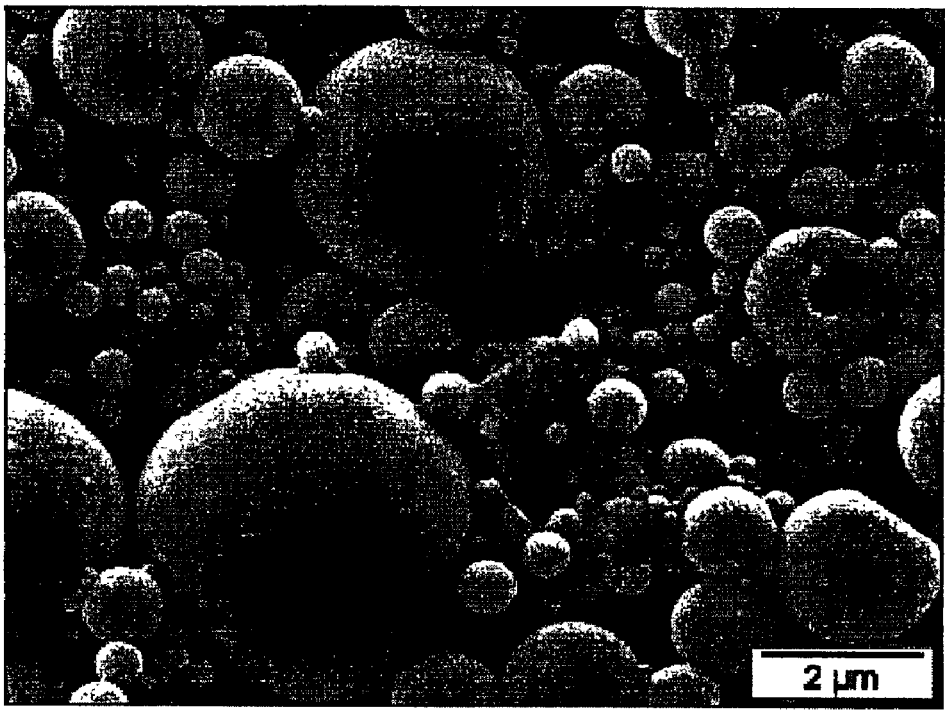
FIG. 2 is scanning electron micrograph of Control Element C-1 described hereafter.
Figure 3:
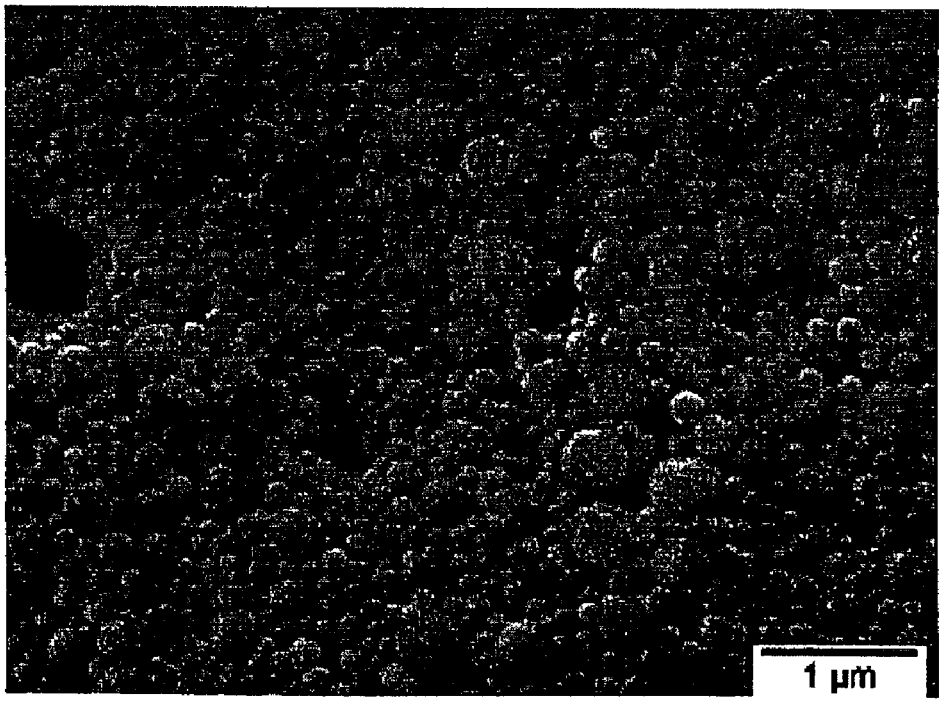
FIG. 3 is scanning electron micrograph of Control Element C-2 described hereafter.
Figure 4:
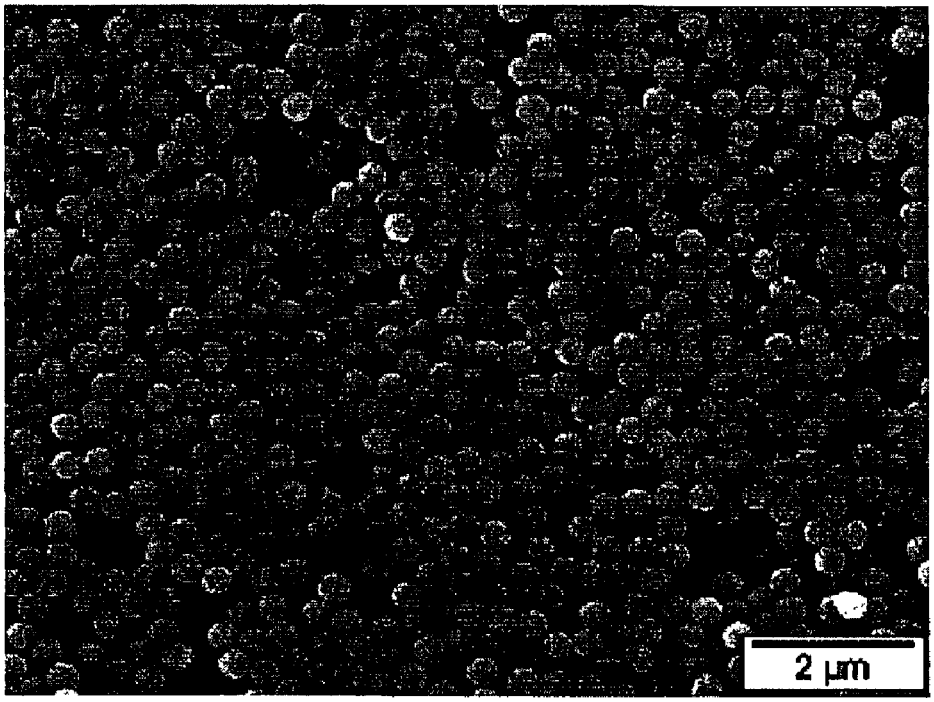
FIG. 4 is scanning electron micrograph of Element 1 of the invention described hereafter.
Figure 5:
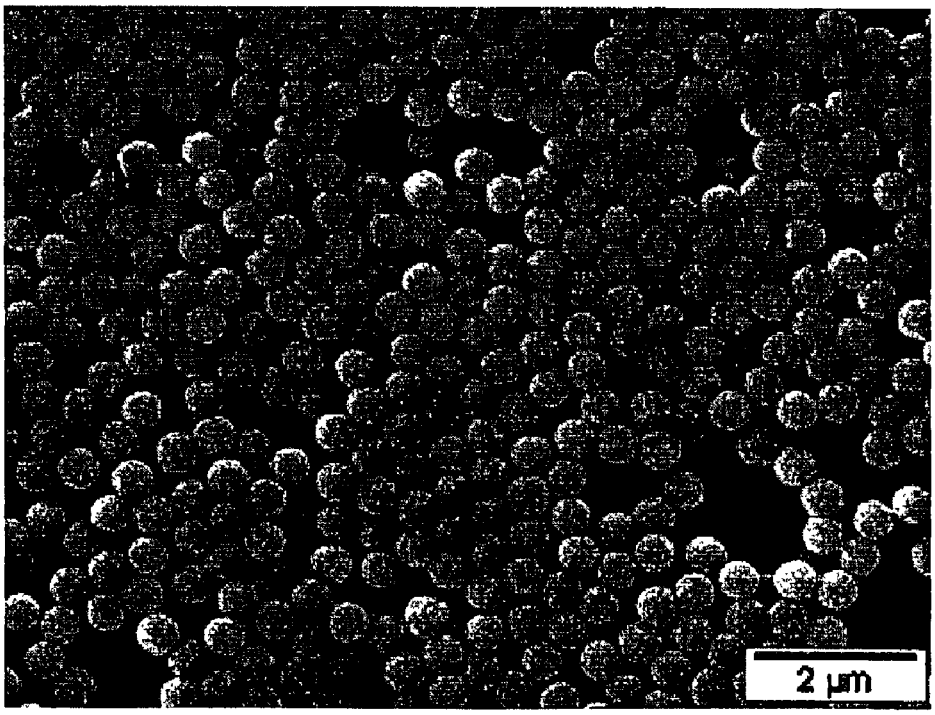
FIG. 5 is scanning electron micrograph of Element 5 of the invention described hereafter.
Figure 6:
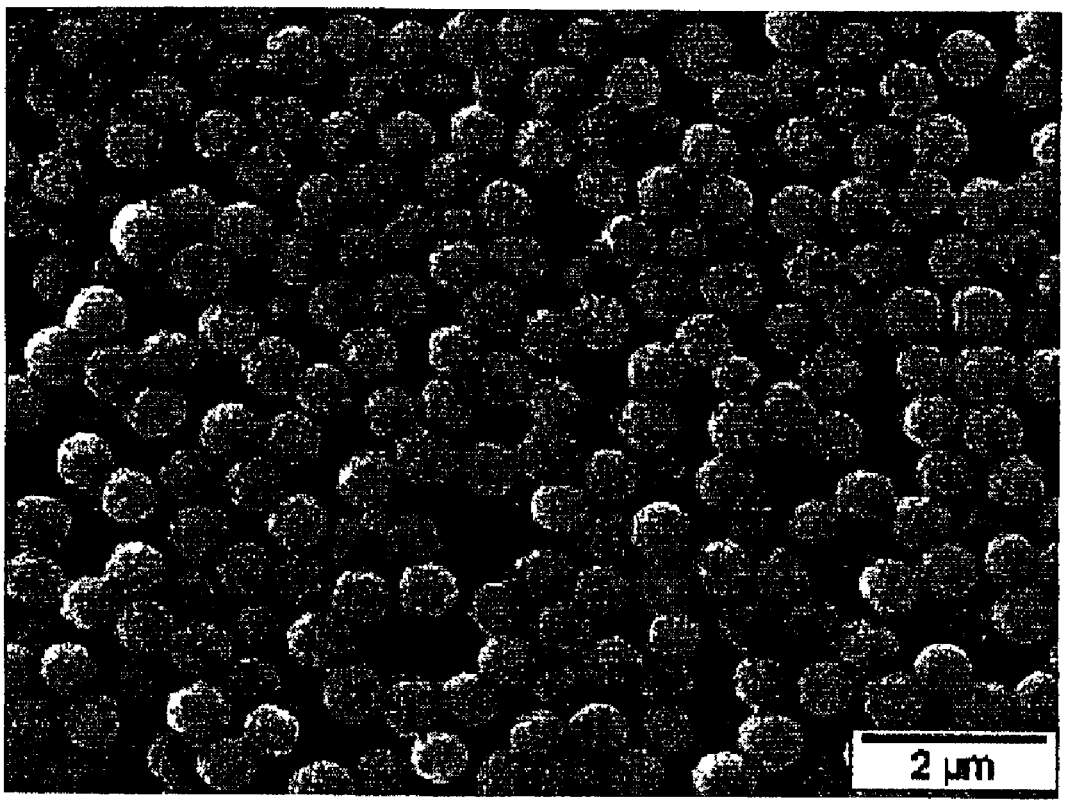
FIG. 6 is scanning electron micrograph of Element 11 of the invention described hereafter.

Polymer particles were characterized by an Ultrafine Particle Analyzer (UPA) manufactured by Leeds & Northrup. Two forms of a graph for presenting particle size data are obtained: the histogram (such as shown in FIG. 1*a*) and the cumulative plot (such as shown in FIG. 1*b*). Percentile points in FIG. 1*b* show the given percent of the volume that is smaller than the indicated size. The 50% is used as the "average particle size". The decade ratio is defined as the ratio of particle size at the $90^{th}$ percentile point to the particle size at the $10^{th}$ percentile point. The smaller the decade ratio, the narrower the particle size distribution. Based on FIG. 1*b* for example, the $90^{th}$ percentile point is 0.74 microns and the $10^{th}$ percentile point is 0.31, thus the decade ratio is 2.39 (0.74 divided by 0.31.)

Table 2 summarizes the prepartion process, the composition, and the properties of polymer particles used in the examples.

TABLE 2

| Particle | Composition (weight %) | Preparation Method Process | Charge | Average Particle Size (nm) | Decade Ratio | Tg (C. °) |
|---|---|---|---|---|---|---|
| P-1 | EM/MM (86/14) | C | Cationic | 523 | 1.488 | 84 |
| P-2 | EM/MM (86/14) | C | Cationic | 440 | 1.404 | 85 |
| P-3 | EM/MM/EGD (88/10/2) | C | Cationic | 455 | 1.463 | 85 |
| P-4 | EM/MM/SSDM EAA (93/5/2) | B | Anionic | 475 | 1.339 | NA |
| P-5 | EM/MM (86/14) | B | Anionic | 375 | 1.497 | 86 |
| P-6 | EM/MM/EGD (88/10/2) | B | Anionic | 513 | 1.294 | 87 |
| P-7 | EM/MM (86/14) | B | Anionic | 505 | 1.436 | 84 |
| P-8 | EM/MM (86/14) | A | Anionic | 864 | 1.708 | NA |
| P-9 | EM/MM (86/14) | A | Anionic | 831 | 1.830 | 82 |
| P-10 | EM/MM (93/7) | A | Anionic | 904 | 1.490 | 82 |
| P-11 | EM/AN (80/20) | A | Anionic | 513 | 1.478 | 67 |
| P-12 | EM/MM/UV-1 (83/10/7) | A | Anionic | 509 | 1.534 | 82 |
| P-13 | EM/MM (86/14) | A | Anionic | 481 | 1.545 | 86 |
| P-14 | EM/MM/SSDM EAA (92/6/2) | A | Anionic | 529 | 1.550 | NA |
| P-15 | EM/MM/SSDM EAA (92/6/2) | A | Anionic | 715 | 1.616 | NA |
| P-16 | EM/MM/SSDM EAA (92/6/2) | A | Anionic | 522 | 1.204 | 80 |
| CP-1 | cellulose acetate butyrate | | Anionic | 975 | 11.837 | 101 |
| CP-2 | EM/MM/SSDM EAA (92/6/2) | | Anionic | 346 | 4.84 | NA |

MM = methyl methacrylate
EM = ethyl methacrylate
EGD = ethylene glycol dimethacrylate
SSDMEAA = sodium 2-sulfo-1,1-dimethylethyl acrylamide
AN = acrylonitrile
UV-1 = refer to Table 1 for structure Low Tg Particle Dispersion B-1

B-1 is a polyurethane dispersion Witcobond W-320® (CK Witco Corporation). The dispersion is nonionic, thus is compatible with anionic or cationic polymer particle dispersions. The average particle size of the dispersion is 3 $\mu$m, and the Tg is −12° C., both quoted from CK Witco Corporation.

Preparation of Control Element C-1

A single layer ink jet porous media was prepared by coating an aqueous solution comprising particles CP-1 and B-1 on a polyethylene-coated paper that was treated with corona-discharge prior to coating. The concentrations of CP-1 and B-1 were 36% and 7.2% by weight respectively. 0.4% of anonionic surfactant, Olin 10G® (Olin Corp.), was used in the coating solution to control the surface tension during coating. The coating solution was laid down at 108.9 g/m$^2$ (10 cc/ft$^2$), and dried at 49° C. for 3 minutes followed by 25° C. for another 8 minutes with forced air circulation.

Preparation of Control Element C-2

Control Element C-1 was prepared similar to C-1, except polymer particle CP-2 was used.

Preparation of Control Element C-3

Control Element C-1 was prepared similar to C-1, except the coating solution containing 32% polymer particle P-7 and 3.2% Airvol 205® polyvinyl alcohol (PVA), (Air Products Corp.).

Preparation of Elements 1–12 of the Invention

Elements 1–12 were prepared similar to C-1, except polymer particles P-2, P-3, P-4, P-6, P-7, P-9, P-10, P-11, P-12, P-14, P-15 and P-16 were used, respectively.

Scanning Electron Microscopy (SEM)

A piece of the element was cut out and mounted on a SEM stub with carbon tape. The surface of the sample was metal coated with platinum-palladium in a vacuum evaporator for electrical conductivity. The sample was examined in a Hitachi S-4100 field-emission gun scanning electron microscope, (FEGSEM), using an electron beam energy of 5 keV. The sample was imaged at a tilt angle of zero degrees and representative images of the coating were captured in the magnification range 2,000× to 50,000×.

SEM images of Control Elements C-1 and C-2 and Elements 1, 5 and 11 of this invention are shown in FIGS. 2–6.

Ink Absorption

Ink jet samples were loaded into an Epson Stylus Photo 820 printer with color ink cartridge T027 and black ink cartridge T026, and printed with a pre-assembled digital image of color patches and pictures. The printed sample was immediately rubbed by a finger on heavily inked areas as it was ejected from the printer. "Instant dry" is defined as the print was dry to the touch and the image was not smudged or damaged by the finger-rubbing action. If the particles coalesced and formed a continuous film on drying after coating, the ink would form droplets on the surface and not penetrate through the layer. Therefore, such an image would be low in optical density and easily smudged by rubbing.

Fusing

The printed samples were fused between a set of heated pressurized rollers, at least one of which was heated at a temperature of 150° C. and a speed of 2.5 cm per second.

Test for Water and Stain Resistance

Ponceau red dye solution was prepared by dissolving 1 g of dye in 1000 g mixture of acetic acid and water (5 parts: 95 parts). An approximately 1 cm-diameter Ponceau Red dye solution was placed on the sample surface for 5 minutes. The liquid was then wiped up with a Sturdi-Wipes paper towel. A visual observation of the tested area was made and recorded. No mark of dye stain left on the image indicates the existence of a water resistant overcoat layer; a red stain on the image indicates no existence of a water resistant overcoat layer.

Image Quality

The elements were examined visually and rated according to the following:

Good=No smearing

Fair=Some smearing

Poor=Severe smearing

The evaluation results of the control elements as well as elements of this invention are summarized in Table 3 below.

TABLE 3

| Element | Polymer Particle | Average Particle Size (nm) | Decade ratio | Ink Absorption | Image Quality | Stain Resistance after fusing |
|---|---|---|---|---|---|---|
| C-1 | CP-1 | 975 | 11.837 | Slow to dry | Poor | Good |
| C-2 | CP-2 | 346 | 4.840 | Slow to dry | Fair | Good |
| C-3 | P-7, but with PVA | 505 | 1.436 | Slow to dry | Poor | Not stain resistant |
| 1 | P-2 | 440 | 1.404 | Instant dry | Good | Good |
| 2 | P-3 | 455 | 1.463 | Instant dry | Good | Good |
| 3 | P-4 | 475 | 1.339 | Instant dry | Good | Good |
| 4 | P-6 | 513 | 1.294 | Instant dry | Good | Good |
| 5 | P-7 | 505 | 1.436 | Instant dry | Good | Good |
| 6 | P-9 | 831 | 1.830 | Instant dry | Good | Good |
| 7 | P-10 | 904 | 1.490 | Instant dry | Good | Good |
| 8 | P-11 | 513 | 1.478 | Instant dry | Good | Good |
| 9 | P-12 | 509 | 1.534 | Instant dry | Good | Good |
| 10 | P-14 | 529 | 1.550 | Instant dry | Good | Good |
| 11 | P-15 | 715 | 1.616 | Instant dry | Good | Good |
| 12 | P-16 | 522 | 1.204 | Instant dry | Good | Good |

The above results show that the ink jet recording elements employed in the invention had improved ink absorption, image quality and stain resistance as compared to the control elements.

Example 2

In this example, several types of ink jet elements were prepared on transparent biaxially oriented poly(ethylene terephthalate) film which is used in medical imaging applications. It is desirable to obtain an image of low haze after fusing to be viewed in a transmission mode.

Preparation of Control Element C-4

This element was a single layer ink jet porous receiving layer consisting of fumed alumina (Cab-O-Sperse PG003®, (Cabot Corp.)), PVA (GH-23, (Nippon Ghosei)), 2,3-dihydroxy-1,4-dioxane (Clariant Corp.) and dye mordanting material MM at a weight ratio of 82.5:7.5:3:7 and a thickness of 20 μm. MM was a crosslinked hydrogel polymer particle of 80 nm in average particle size prepared from 87% by weight of N-vinylbenzyl-N,N,N-trimethylammonium chloride and 13% by weight of divinylbenzene. 0.07% of a nonionic surfactant, Olin 10G® (Olin) was used in the coating solution to control the surface tension during coating.

Preparation of Control Element C-5

This element was a single layer ink jet porous layer consisted of PVA (Airvol 205®), 5.9 μm silica gel (23F, (Crossfield)) and 2,3-dihydroxy-1,4-dioxane (Clariant Corp.) at a weight ratio of 48.8:48.8:2.4 and a thickness of 20 μm.

Preparation of Elements 13 Through 26 of this Invention

These elements were prepared similar to Elements 1 to 12, except that different polymer particles were used and were coated on poly(ethylene terephthalate) film. The specific particle used for each element is listed in Table 4 below.

Ink Absorption and Fusing

These elements were printed and fused as in Example 1. A pre-assembled digital image containing black-and white medical X-ray image and gray scales was used for printing.

Film Appearance After Fusing

The elements were examined after fusing and rated as follows:

Good=Clear or transparent

Poor=Hazy

The following results were obtained:

TABLE 4

| Element | Particles | Ink Absorption | Image Quality | Film Appearance after fusing | Stain Resistance after fusing |
|---|---|---|---|---|---|
| C-4 | Fumed Alumina with PVA | Instant dry | Good | Poor | Not stain resistant |
| C-5 | Silica gel with PVA | Instant dry resistant | Good | Poor | Not stain |
| 13 | P-1 | Instant dry | Good | Good | Good |
| 14 | P-2 | Instant dry | Good | Good | Good |
| 15 | P-4 | Instant dry | Good | Good | Good |
| 16 | P-5 | Instant dry | Good | Good | Good |
| 17 | P-6 | Instant dry | Good | Good | Good |
| 18 | P-7 | Instant dry | Good | Good | Good |
| 19 | P-8 | Instant dry | Good | Good | Good |
| 20 | P-10 | Instant dry | Good | Good | Good |
| 21 | P-11 | Instant dry | Good | Good | Good |
| 22 | P-12 | Instant dry | Good | Good | Good |
| 23 | P-13 | Instant dry | Good | Good | Good |
| 24 | P-14 | Instant dry | Good | Good | Good |
| 25 | P-15 | Instant dry | Good | Good | Good |
| 26 | P-16 | Instant dry | Good | Good | Good |

The above results show that the commonly used layer compositions for ink jet elements, such as Control Elements C-4 and C-5, are not appropriate for medical imaging applications, due to their high light-scattering property. Elements 13–26 of the invention provided transparent images, in addition to fast ink absorption and satisfactory image quality, and thus are especially suitable for ink jet medical imaging applications.

Element 13 was further examined for pore volume in the ink-receiving layer. It was carried out using Mercury Intrusion Porosimetry, model 9520 from Micromeritics Instrument Corporation. The volume of mercury that penetrated into the pores as a function of applied hydraulic pressure to the mercury/sample combination was measured. As the quantity of mercury intruded, the amount of pore volume was measured by the change in electrical capacitance as the column of mercury above the mercury/sample bulk decreases as mercury intrudes into the sample. A measured pore volume of 19.5 ml/m$^2$ was obtained for Element 13.

Example 3

In this example, two pigment-based ink sets were printed on Element 3 of the invention, and then allowed to dry and fused as described in Example 1. The two sets of pigments ink were different in the average particle size of pigment dispersions, as measured by UPA for particle size measurement described in Example 1. Epson inks used for Epson C80 printer, filled in Epson ink cartridges T0322 (cyan), T0323 (magenta) and T0324 (yellow) and three additional pigmented inks prepared by the inventors following similar methods described in U.S. Pat. Nos. 5,679,138; 5,670,139; 6,152,999 and 6,210,474 were used for printing. The particle sizes of pigments used in these inks are listed in Table 5.

TABLE 5

| Ink | Color | Average Particle Size of pigment (nm) |
|---|---|---|
| 1 | Cyan (T0322) | 90 |
| 2 | Magenta (T0323) | 120 |
| 3 | Yellow (T0324) | 15 |
| 4 | Cyan | 38 |

TABLE 5-continued

| Ink | Color | Average Particle Size of pigment (nm) |
|---|---|---|
| 5 | Magenta | 11 |
| 6 | Yellow | 11 |

After fusing, the prints were examined for rub resistance on the inked areas by rubbing the samples with a dry paper towel for 8 passes under a pressure of 200 g over a 3.5 cm diameter area. The elements were examined and rated as follows:

Good=Image was undamaged

Poor=Image was rubbed off with scratch lines on the surface.

The following results were obtained:

TABLE 6

| Element | Ink | Rub Resistance |
|---|---|---|
| 3 | 1 | Poor |
| 3 | 2 | Poor |
| 3 | 3 | Good |
| 3 | 4 | Good |
| 3 | 5 | Good |
| 3 | 6 | Good |

The above results show that pigments having an average particle size of 90 nm or greater printed on Element 3 of this invention are poor for rub resistance.

These prints were cross-sectioned and furthered examined by optical microscopy for colorant location. It was evident that the pigments used in inks 1 and 2 stayed on the surface of Element 3, and the pigments used in inks 3 to 6 penetrated into the ink receiving layer. This indicates that average particle size of pigments used in inks are preferably less than 90 nm in order to achieve satisfactory rub resistance in the imaged area.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method comprising the steps of:

A) providing an ink jet printer that is responsive to digital data signals;

B) loading said printer with an ink jet recording element comprising a support having thereon a fusible, porous, image-receiving layer comprising at least two types of hydrophobic polymer particles having different glass transition temperatures, the first type of hydrophobic polymer particles having a glass transition temperature, Tg higher than about 60° C. that is substantially monodisperse and the second type of hydrophobic polymer particles having a glass transition temperature, Tg lower than about 25° C. wherein said first type of hydrophobic polymer particles has an average particle size of from about 0.2 $\mu$m to about 2 $\mu$m, and has a particle size distribution such that the ratio of the particle size at the 90$^{th}$ percentile of the particle size distribution curve to the particle size at the 10$^{th}$ percentile of the particle size distribution curve is less than about 2 and wherein the weight ratio of the first type of hydrophobic polymer particles to the second type of hydrophobic polymer particles is from about 10:1 to about 2.5:1;

C) loading said printer with an ink jet ink; and

D) printing on said image-receiving layer using said ink jet ink in response to said digital data signals E) fusing said image-receiving layer with heat and/or pressure to form a substantially continuous, transparent layer.

2. The method of claim 1 wherein said first type of hydrophobic polymer particles which is substantially monodisperse has a Tg of from about 60° C. to about 140° C.

3. The method of claim 1 wherein said second type of hydrophobic polymer particles has a Tg of from about −60° C. to about 25° C.

4. The method of claim 1 wherein said porous, image-receiving layer is coated in an amount of from about 10 $g/m^2$ to about 60 $g/m^2$.

5. The method of claim 1 wherein said support is resin-coated paper or a transparent polymer film.

6. The method of claim 1 wherein said porous, image-receiving layer is cross-linked.

7. The method of claim 1 wherein said porous, image-receiving layer contains an ultraviolet absorbing agent.

8. The method of claim 1 wherein the pore volume of said fusible, porous, image-receiving layer is from about 5 to about 50 $ml/m^2$.

9. The method of claim 1 wherein said ink jet ink contains an anionic dye and said first type of hydrophobic polymer particles in said image-receiving layer is cationic.

10. The method of claim 1 wherein said ink jet ink contains a cationic dye and said first type of hydrophobic polymer particles in said image-receiving layer is anionic.

11. The method of claim 1 wherein said ink jet ink contains a pigment.

12. The method of claim 11 wherein the average particle size of said pigment is less than about 200 nm.

13. The method of claim 11 wherein the average particle size of said pigment is less than about 90 nm.

14. The method of claim 11 wherein the average particle size of said pigment is about 18% or less than the average particle size of the first type of hydrophobic polymer particles used in said recording element.

* * * * *